US009315054B2

(12) United States Patent
Supron et al.

(10) Patent No.: US 9,315,054 B2
(45) Date of Patent: Apr. 19, 2016

(54) SELF-ADJUSTING PAPER BUCKET FOR A PRINTER AND METHODS FOR PROVIDING A SELF-ADJUSTING PAPER BUCKET

(71) Applicant: TransAct Technologies Incorporated, Hamden, CT (US)

(72) Inventors: Steven A. Supron, Ithaca, NY (US); Jeffrey S. Koepele, Ithaca, NY (US)

(73) Assignee: TransAct Technologies Incorporated, Hamden, CT (US)

( * ) Notice: Subject to any disclaimer, the term of this patent is extended or adjusted under 35 U.S.C. 154(b) by 4 days.

(21) Appl. No.: 14/039,265

(22) Filed: Sep. 27, 2013

(65) Prior Publication Data

US 2015/0093172 A1 Apr. 2, 2015

(51) Int. Cl.

| | |
|---|---|
| ***B41J 11/00*** | (2006.01) |
| ***B41J 15/04*** | (2006.01) |
| ***B65H 16/08*** | (2006.01) |

(52) U.S. Cl.

CPC ..... *B41J 15/046* (2013.01); *B65H 16/08* (2013.01); *B65H 2220/04* (2013.01); *B65H 2301/41398* (2013.01); *B65H 2402/442* (2013.01); *B65H 2511/12* (2013.01); *B65H 2701/1936* (2013.01); *B65H 2801/12* (2013.01)

(58) Field of Classification Search

CPC ..... B41J 15/04; B41J 11/003; B41J 11/0025
USPC ..... 400/619
See application file for complete search history.

(56) References Cited

U.S. PATENT DOCUMENTS

| | | | | |
|---|---|---|---|---|
| 2,170,147 | A | 8/1939 | Lane | |
| 4,979,838 | A | 12/1990 | Yokota et al. | |
| 4,981,059 | A | 1/1991 | Kobayashi | |
| 5,174,824 | A | 12/1992 | Salancy et al. | |
| 5,358,346 | A * | 10/1994 | Schmidt et al. | 400/619 |
| 5,531,530 | A | 7/1996 | Kuramoto et al. | |
| 5,690,437 | A | 11/1997 | Yanagisawa et al. | |
| 6,158,342 | A * | 12/2000 | Moore | 101/407.1 |
| 6,302,604 | B1 * | 10/2001 | Bryant et al. | 400/619 |

(Continued)

FOREIGN PATENT DOCUMENTS

| | | |
|---|---|---|
| JP | 60161851 | 8/1985 |
| JP | 05278906 | 10/1993 |

OTHER PUBLICATIONS

Pitney Bowes Brochure, Accelerated processing, Digital Mailing System with IntelliLink® Technology DM400™ Series, 4 pages, 2008.

*Primary Examiner* — David Banh

(74) *Attorney, Agent, or Firm* — Lipsitz & McAllister, LLC

(57) ABSTRACT

A self-adjusting paper bucket for a printer is provided, together with methods for providing such a self-adjusting paper bucket. The paper bucket may have a curved base portion for accepting paper rolls of varying widths. A guide may be movably mounted to each side of the base portion. The guides may be movable between a first position extending towards a center of the paper bucket and a second position folded against sides of the paper bucket. A biasing element may be provided for each of the guides for biasing the corresponding guide into the first position. In the first position, the guides may accept a first paper roll having a first width and may center the first paper roll in the base portion. In the second position, the guides may accept a second paper roll having a second width greater than the first width and may center the second paper roll in the base portion.

14 Claims, 5 Drawing Sheets

(56) References Cited

U.S. PATENT DOCUMENTS

| | | | | |
|---|---|---|---|---|
| 6,565,273 | B2 * | 5/2003 | Yamada | 400/512 |
| 6,609,844 | B1 * | 8/2003 | Petteruti et al. | 400/88 |
| 6,622,622 | B2 * | 9/2003 | Lee et al. | 101/228 |
| 7,404,683 | B2 * | 7/2008 | Mochizuki et al. | 400/613.1 |
| 7,588,811 | B2 | 9/2009 | Blank et al. | |
| 7,635,230 | B2 * | 12/2009 | Liao et al. | 400/613 |
| 7,703,998 | B2 * | 4/2010 | Williams | 400/613 |
| 8,147,155 | B2 * | 4/2012 | Maekawa | 400/613 |
| 8,231,289 | B2 * | 7/2012 | Chen | 400/618 |
| 2004/0018035 | A1 * | 1/2004 | Petteruti et al. | 400/88 |
| 2007/0110493 | A1 | 5/2007 | Chen | |
| 2007/0231043 | A1 | 10/2007 | Miyashita et al. | |
| 2007/0262141 | A1 | 11/2007 | Ito et al. | |
| 2009/0114758 | A1 * | 5/2009 | Yamada | 242/566 |
| 2011/0076084 | A1 * | 3/2011 | Kasugai et al. | 400/613 |
| 2012/0155946 | A1 * | 6/2012 | Colonel et al. | 400/691 |
| 2012/0205418 | A1 * | 8/2012 | Horie et al. | 226/168 |
| 2013/0243510 | A1 | 9/2013 | Supron et al. | |

* cited by examiner

SELF-ADJUSTING PAPER BUCKET FOR A PRINTER AND METHODS FOR PROVIDING A SELF-ADJUSTING PAPER BUCKET

BACKGROUND OF THE INVENTION

The present invention relates to the field of printers. More specifically, the present invention relates to a self-adjusting paper bucket for a printer that uses rolls of paper.

Various types of printers that print on rolls of paper may be used in different environments that require different paper widths. For example, printers using rolls of paper may include point-of-sale printers, label printers used for inventory control and food preparation, ATM printers, lottery ticket printers, gaming machine printers, and the like. Depending on the environment, different width paper rolls may be used or required.

Prior art printers are either manufactured with a fixed bucket width for one of several standard-sized paper rolls, or use removable screw mounted side guides, manually adjustable side guides, or manually adjustable spindle stops, all which require user adjustment before changing roll size.

It would be advantageous to provide a self-adjusting paper bucket that can accommodate 2 different widths of paper rolls without manual adjustment or user intervention. It would be advantageous to provide a paper bucket that automatically adjusts to accommodate different roll sizes upon the insertion of a paper roll into the paper bucket. It would also be advantageous if the paper size could be sensed once inserted into the paper bucket so that the print mechanism can be configured automatically according to the sensed paper roll size.

The apparatus and methods of the present invention provide the foregoing and other advantages.

SUMMARY OF THE INVENTION

The present invention relates to a self-adjusting paper bucket for a printer and methods for providing a self-adjusting paper bucket for a printer.

In an example embodiment of a self-adjusting paper bucket for a printer in accordance with the present invention, the paper bucket may comprise a curved base portion for accepting paper rolls of varying widths. A guide may be movably mounted to each side of the base portion. The guides may be movable between a first position extending towards a center of the paper bucket and a second position folded against sides of the paper bucket. A biasing element may be provided for each of the guides for biasing the corresponding guide into the first position. In the first position, the guides may accept a first paper roll having a first width and may center the first paper roll having the first width in the base portion. In the second position, the guides may accept a second paper roll having a second width greater than the first width and may center the second paper roll having the second width in the base portion.

The insertion of the second paper roll having the second width may move the guides from the first position into the second position against a biasing force of the biasing elements. The guides may be mounted on the base portion for pivotal movement between the first and second positions.

The self-adjusting paper bucket may further comprise a plurality of stepped paper rollers aligned with each other on opposite sides of the base portion to form pairs of stepped paper rollers. A width between steps of each pair of the stepped paper rollers may correspond to the first width of the first paper roll. Four pairs of stepped paper rollers may be arranged in the base portion. The first paper roll having the first width may sit on a smaller diameter section of each of the stepped paper rollers and between larger diameter sections of each of the pairs of stepped paper rollers. The second paper roll having the second width may sit on the larger diameter sections of the paper rollers.

A sensor may be provided for sensing a movement of the guides between the first and second positions to determine a size of the paper roll inserted into the base portion. The sensor may signal a controller to configure a print mechanism of the printer in accordance with the determined size of the paper roll.

The present invention also includes methods for providing a self-adjusting paper bucket for a printer. In one example embodiment of such a method in accordance with the present invention, the method may comprise providing a curved base portion for accepting paper rolls of varying widths, movably mounting a guide to each side of the base portion, the guides being movable between a first position extending towards a center of the paper bucket and a second position folded against sides of the paper bucket, and biasing each of the guides into the first position. In the first position, the guides may accept a first paper roll having a first width and may center the first paper roll having the first width in the base portion. In the second position, the guides may accept a second paper roll having a second width greater than the first width and may center the second paper roll having the second width in the base portion.

The method may also include additional features discussed above in connection with the various embodiments of the self-adjusting paper bucket.

BRIEF DESCRIPTION OF THE DRAWINGS

The present invention will hereinafter be described in conjunction with the appended drawing figures, wherein like reference numerals denote like elements, and.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

The present invention relates to a self-adjusting paper bucket for a printer and methods for providing a self-adjusting paper bucket for a printer. The paper bucket in accordance with the present invention is designed to handle two different widths of paper rolls without any manual adjustment.

Figure 1:
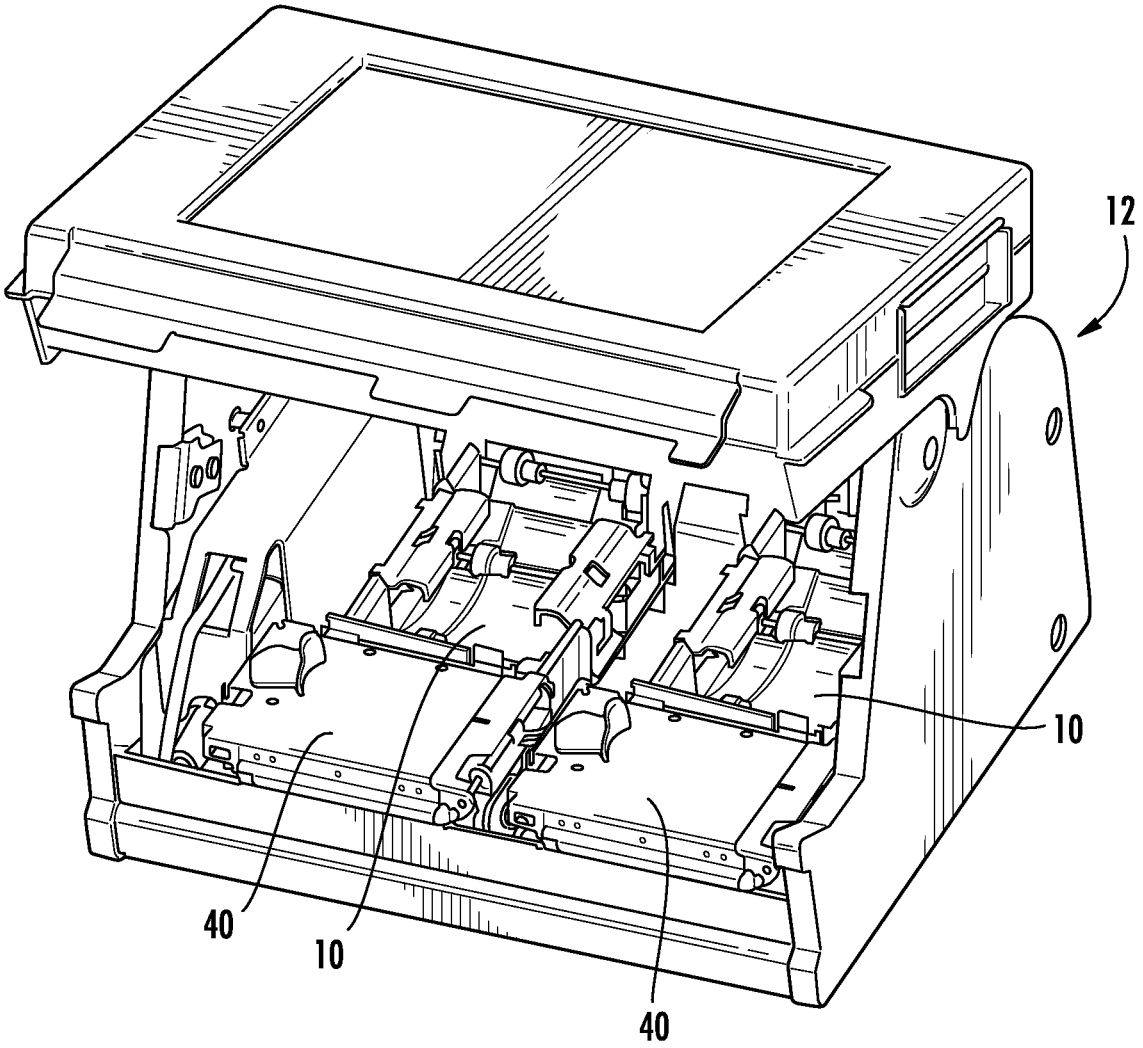
FIG. 1 shows an example embodiment of a self-adjusting paper bucket for a printer in accordance with the present invention.
Figure 2:
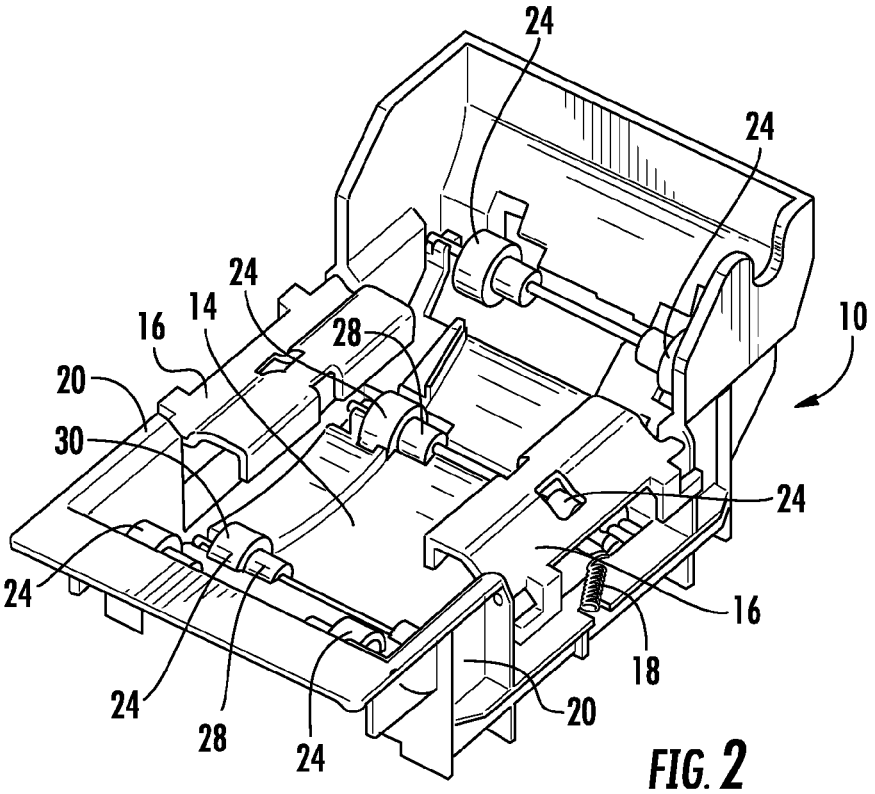
FIG. 2 shows the self-adjusting paper bucket of FIG. 1 removed from the printer with guides in a first position.
Figure 3:
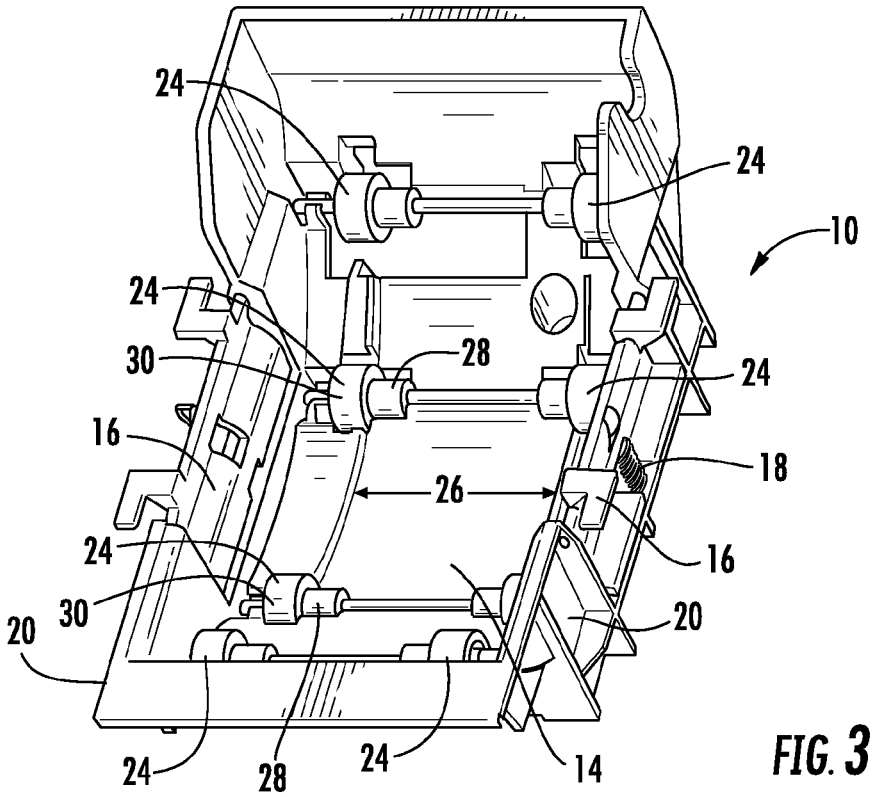
FIG. 3 shows the self-adjusting paper bucket of FIG. 1 removed from the printer with guides in a second position.

An example embodiment of a self-adjusting paper bucket for a printer in accordance with the present invention is shown in FIGS. 1-3. FIG. 1 shows an example embodiment of a paper bucket 10 in accordance with the present invention installed in an interior of a printer 12. Although FIG. 1 shows a printer 12 configured with two paper buckets 10 and corresponding print mechanisms 40, it should be appreciated that the present invention can be implemented in a printer 12 having only a single paper bucket 10 and a single print mechanism 40.

FIGS. 2 and 3 show the paper bucket 10 removed from the printer 12. As can be seen in FIGS. 2 and 3, the paper bucket 10 may comprise a curved base portion 14 for accepting paper rolls of varying widths. A guide 16 may be movably mounted to each side of the base portion 14. The guides 16 may be movable between a first position extending towards a center of the paper bucket (shown in FIG. 2) and a second position folded against sides 20 of the paper bucket (shown in FIG. 3). A biasing element 18 may be provided for each of the guides 16 for biasing the corresponding guide 16 into the first position. In the first position (as shown in FIG. 2), the guides 16 may accept a first paper roll having a first width and may center the first paper roll having the first width in the base portion 14. In the second position, the guides 16 may accept a second paper roll having a second width greater than the first width and may center the second paper roll having the second width in the base portion 14.

The biasing elements 18 may comprise helical springs. Those skilled in the art will appreciate that other types of biasing elements may be used, including but not limited to different types of springs, resilient levers, and the like. The biasing elements 18 provide a light force that is adequate to hold the guides 16 in the first position to accept the smaller paper roll, yet light enough to minimize any added drag when a larger paper roll is inserted into the paper bucket 10.

The insertion of the second paper roll having the second width may move the guides 16 from the first position into the second position against a biasing force of the biasing elements 18. The guides 16 may be mounted on the base portion 14 for pivotal movement between the first and second positions. As shown in FIGS. 2 and 3, the guides 16 may be mounted in or on side walls 20 of the base portion 14, for example via rod-like extensions of the guides 16 inserted into bores of the side walls 20. Other forms of pivotal mounting of the guides 16 may be used, as would be apparent to those of ordinary skill in the art, including but not limited to a hinge connection, and the like.

Figure 4:
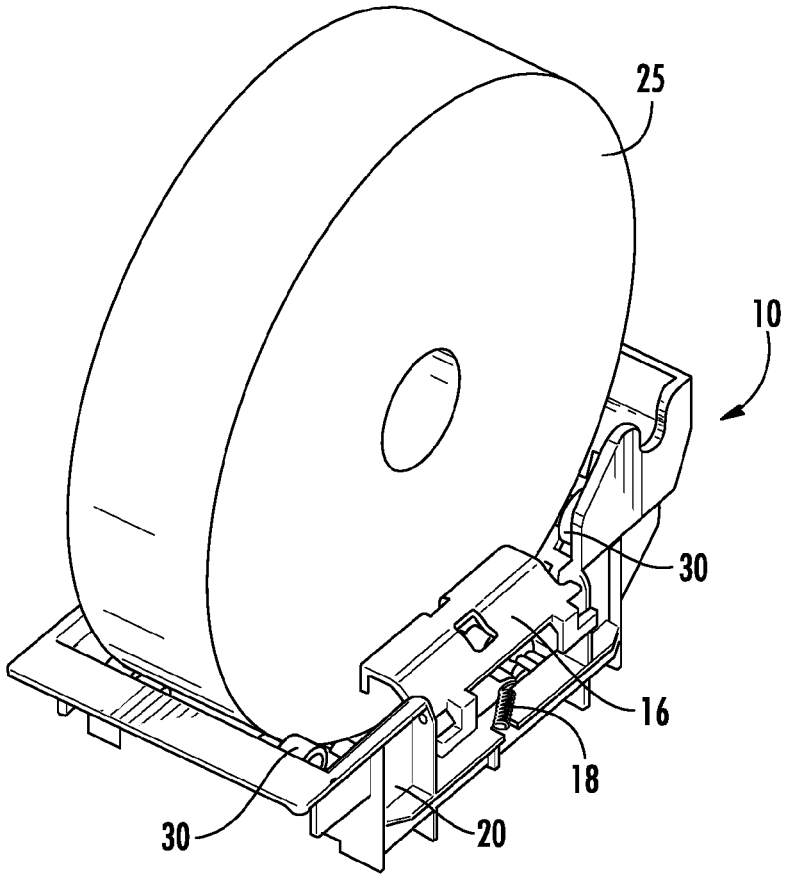
FIG. 4 shows the self-adjusting paper bucket of FIG. 2 holding a narrow width paper roll.
Figure 5:
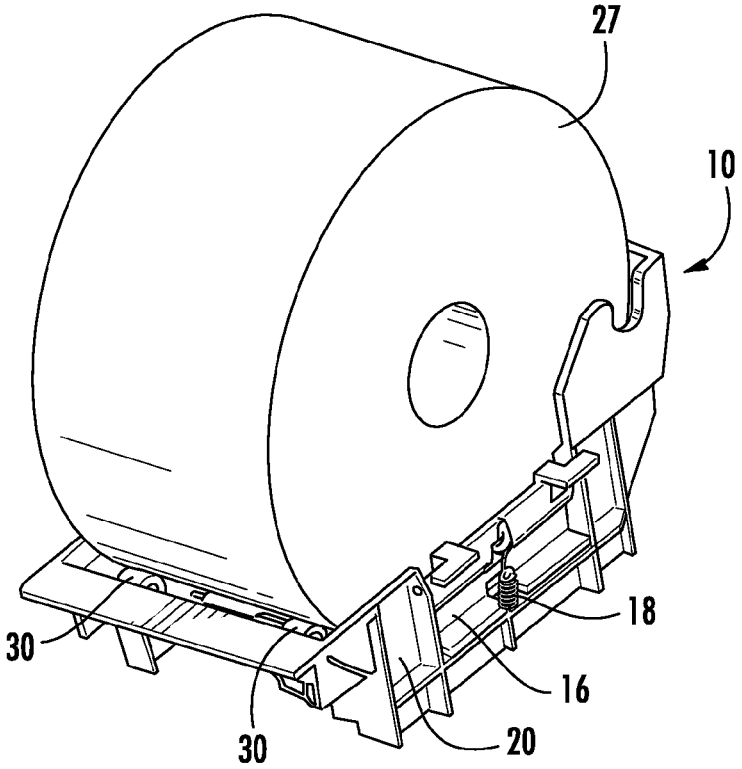
FIG. 5 shows the self-adjusting paper bucket of FIG. 3 holding a wider width paper roll.

The self-adjusting paper bucket 10 may further comprise a plurality of stepped paper rollers 24 aligned with each other on opposite sides of the base portion to form pairs of stepped paper rollers 24. A width 26 (shown in FIG. 3) between steps of each pair of the stepped paper rollers 24 may correspond to the first width of the first paper roll. Four pairs of stepped paper rollers 24 may be arranged in the base portion 14. The first paper roll having the first width may sit on a smaller diameter section 28 of each of the stepped paper rollers 24 and between larger diameter sections 30 of each of the pairs of stepped paper rollers 24. The second paper roll having the second width may sit on the larger diameter sections 30 of the paper rollers 24. FIG. 4 shows the first paper roll 25 sitting in the paper bucket 10 with the guides 16 in the first position. FIG. 5 shows the second paper roll 27 sitting in the paper bucket 10 with the guides 16 in the second position.

The smaller diameter section 28 of the stepped rollers 24 provides side guidance to the smaller first paper roll 25 at the base of the roll. This guidance on the smaller first paper roll 25 helps the paper roll stay in a lateral position in the base portion 14, especially as the printer unit 12 is moved. When a larger second paper roll 27 is loaded into the base portion 14, the paper roll 27 sits on top of the larger diameter sections 30 of the paper rollers 24 and guidance is provided by the bucket sides 20 and the folded guides 16.

Figure 6:
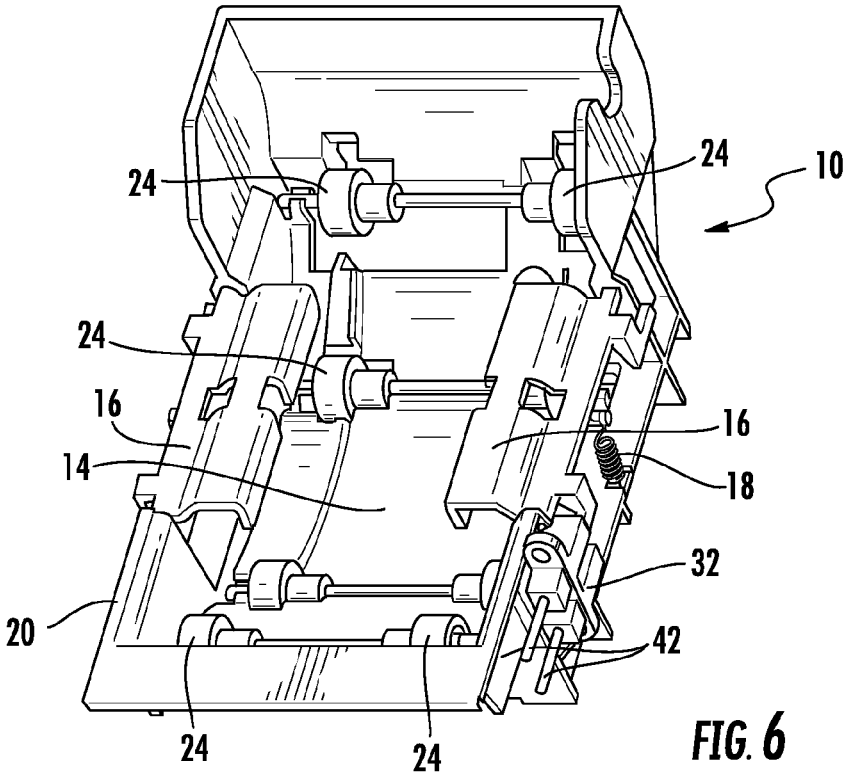
FIG. 6 shows a further example embodiment of a self-adjusting paper bucket in accordance with the present invention with a sensor mechanism and guides in the first position.
Figure 7:
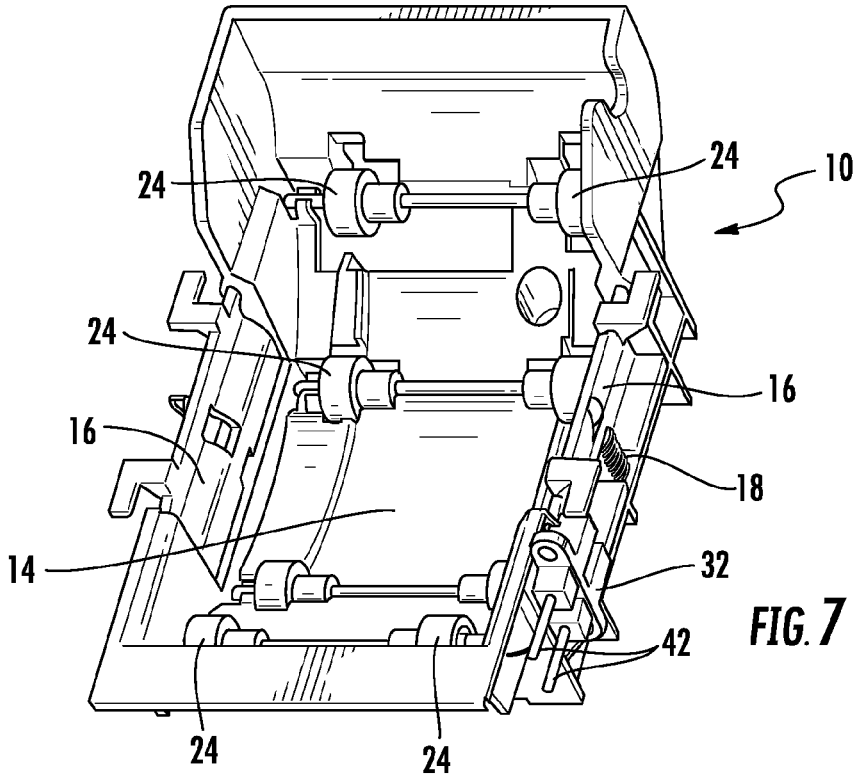
FIG. 7 shows the self-adjusting paper bucket of FIG. 6 with the guides in the second position.

As shown in FIGS. 6 and 7, a sensor 32 may be provided for sensing a movement of the guides 16 between the first position (shown in FIG. 4) and second position (shown in FIG. 5) to determine a size of the paper roll inserted into the base portion 14. The sensor 32 may signal a controller to configure a print mechanism 40 (FIG. 1) of the printer in accordance with the determined size of the paper roll. The controller is not shown in the figures but those skilled in the art will appreciate that it can be located inside the print mechanism 40, or as part of the printer separate from the print mechanism 40. In FIGS. 6 and 7, the sensor 32 is adapted to connect with the print mechanism 40 via connectors 42.

Figure 8:
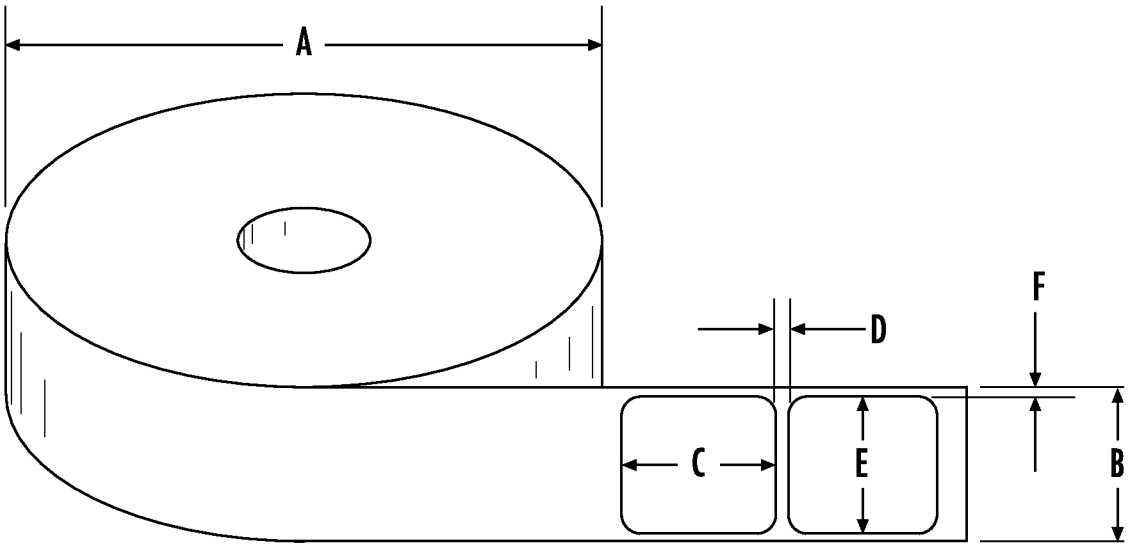
FIG. 8 shows a paper roll with standard dimensions that can be used in connection with the present invention.

As an example, with the present invention, the spring loaded guides 16 may adjust automatically to accommodate standard paper rolls that are either approximately 1.325 or 2.325 inches wide. Dimensions common to both paper rolls are as follows and shown in FIG. 8: Roll diameter A of approximately 4.5 inches, label spacing D of approximately 0.125 inches, label margin F (both sides) of approximately 0.062 inches, and label radii of approximately 0.125 inches. The ability to accommodate two paper widths advantageously allows a printer having such a self-adjusting paper bucket to handle a wide variety of label options, such as those included in Table 1 below.

TABLE 1

| Label ID | Roll Width (B) | +/− Tolerance | Label Width (E) | +/− Tolerance | Label Length (C) | +/− Tolerance | #Labels Per Roll |
|---|---|---|---|---|---|---|---|
| 100-97001 | 1.325 | .02 | 1.2 | 0.1 | 1.1 | .02 | 1900 |
| 100-97002 | 1.325 | .02 | 1.2 | 0.1 | 1.0 | .02 | 1900 |
| 100-97003 | 2.325 | .02 | 2.2 | 0.1 | 1.0 | .02 | 1900 |
| 100-97004 | 2.325 | .02 | 2.2 | 0.1 | 1.0 | .02 | 1432 |
| 100-97005 | 2.325 | .02 | 2.2 | 0.1 | 2.0 | .02 | 1095 |
| 100-97006 | 2.325 | .02 | 2.2 | 0.1 | 2.0 | .02 | 1095 |
| 100-97007 | 2.325 | .02 | 2.2 | 0.1 | 3.0 | .02 | 745 |
| 100-97008 | 2.325 | .02 | 2.2 | 0.1 | 4.0 | .02 | 564 |

The present invention also includes methods for providing a self-adjusting paper bucket for a printer. In one example embodiment of such a method in accordance with the present invention, the method may comprise providing a curved base portion 14 for accepting paper rolls of varying widths, movably mounting a guide 16 to each side 20 of the base portion 14, the guides 16 being movable between a first position extending towards a center of the paper bucket 10 and a second position folded against sides 20 of the paper bucket 10, and biasing each of the guides 16 into the first position. In the first position, the guides 16 may accept a first paper roll having a first width and may center the first paper roll having the first width in the base portion 14. In the second position, the guides 16 may accept a second paper roll having a second width greater than the first width and may center the second paper roll having the second width in the base portion 14.

The method may also include additional features discussed above in connection with the various embodiments of the self-adjusting paper bucket.

It should now be appreciated that the present invention provides an advantageous self-adjusting paper bucket for a printer and methods for providing such a self-adjusting paper bucket.

Although the invention has been described in connection with various illustrated embodiments, numerous modifications and adaptations may be made thereto without departing from the spirit and scope of the invention as set forth in the claims.

What is claimed is:

1. A self-adjusting paper bucket for a printer, comprising:

a curved base portion for accepting paper rolls of varying widths;

two oppositely disposed spring-loaded guides, each of the two guides being pivotably mounted to a corresponding opposing side of the base portion, each of the two guides being pivotable between a first position extending towards a center of the base portion and a second position folded against the sides of the base portion; and a resilient biasing element for each of the two guides for biasing the corresponding guide into the first position, each of the resilient biasing elements comprising a spring;

wherein:

in the first position, the two guides accept a first paper roll having a first width between the two guides and automatically center the first paper roll having the first width in the base portion; and in the second position, the two guides accept a second paper roll having a second width greater than the first width between the two guides and automatically center the second paper roll having the second width in the base portion.

2. A self-adjusting paper bucket in accordance with claim 1, wherein insertion of the second paper roll having the second width moves the guides from the first position into the second position against a biasing force of the biasing elements.

3. A self-adjusting paper bucket in accordance with claim 1, further comprising:

a plurality of stepped paper rollers aligned with each other on opposite sides of the base portion to form pairs of stepped paper rollers; and a width between steps of each pair of the stepped paper rollers corresponding to the first width of the first paper roll.

4. A self-adjusting paper bucket in accordance with claim 3, wherein four pairs of stepped paper rollers are arranged in the base portion.

5. A self-adjusting paper bucket in accordance with claim 3, wherein:

the first paper roll having the first width sits on a smaller diameter section of each of the stepped paper rollers and between larger diameter sections of each of the pairs of stepped paper rollers; and the second paper roll having the second width sits on the larger diameter sections of the paper rollers.

6. A self-adjusting paper bucket in accordance with claim 1, further comprising:

a sensor for sensing a movement of the guides between the first and second positions to determine a size of the paper roll inserted into the base portion.

7. A self-adjusting paper bucket in accordance with claim 6, wherein the sensor signals a controller to configure a print mechanism of the printer in accordance with the determined size of the paper roll.

8. A method for providing a self-adjusting paper bucket for a printer, comprising:

providing a curved base portion for accepting paper rolls of varying widths;

pivotably mounting a spring-loaded guide to a corresponding opposing side of the base portion to provide two oppositely disposed guides, each of the two guides being pivotable between a first position extending towards a center of the base portion and a second position folded against the sides of the base portion;

biasing each of the two guides into the first position via a resilient biasing element, each of the resilient biasing elements comprising a spring;

wherein:

in the first position, the two guides accept a first paper roll having a first width between the two guides and automatically center the first paper roll having the first width in the base portion; and in the second position, the two guides accept a second paper roll having a second width greater than the first width between the two guides and automatically center the second paper roll having the second width in the base portion.

9. A method in accordance with claim 8, wherein insertion of the second paper roll having the second width moves the guides from the first position into the second position against a biasing force of the biasing elements.

10. A method in accordance with claim 8, further comprising:

providing a plurality of stepped paper rollers aligned with each other on opposite sides of the base portion to form pairs of stepped paper rollers;

wherein a width between steps of each pair of the stepped paper rollers corresponds to the first width of the first paper roll.

11. A method in accordance with claim 10, wherein four pairs of stepped paper rollers are arranged in the base portion.

12. A method in accordance with claim 10, wherein:

the first paper roll having the first width sits on a smaller diameter section of each of the stepped paper rollers and between a larger diameter section of each of the pairs of stepped paper rollers; and the second paper roll having the second width sits on the larger diameter sections of the paper rollers.

13. A method in accordance with claim 8, further comprising:

sensing a movement of the guides between the first and second positions; and determining a size of the paper roll inserted into the base portion based on the sensed movement of the guides.

14. A method in accordance with claim 13, further comprising:

configuring a print mechanism of the printer in accordance with the determined size of the paper roll.

* * * * *